US010745942B2

(12) United States Patent
Lehner, Jr. et al.

(10) Patent No.: US 10,745,942 B2
(45) Date of Patent: Aug. 18, 2020

(54) DOGGING SECURITY INDICATOR FOR EXIT DEVICE

(71) Applicant: Schlage Lock Company LLC, Carmel, IN (US)

(72) Inventors: Jack R. Lehner, Jr., Indianapolis, IN (US); Linda Ainza, Westfield, IN (US); Ryan Williams, Beech Grove, IN (US)

(73) Assignee: Schlage Lock Company LLC, Carmel, IN (US)

( * ) Notice: Subject to any disclaimer, the term of this patent is extended or adjusted under 35 U.S.C. 154(b) by 93 days.

(21) Appl. No.: 15/955,281

(22) Filed: Apr. 17, 2018

(65) Prior Publication Data

US 2019/0024414 A1 Jan. 24, 2019

Related U.S. Application Data

(63) Continuation of application No. 14/614,885, filed on Feb. 5, 2015, now Pat. No. 9,945,158.

(51) Int. Cl.
*E05B 65/10* (2006.01)
*E05B 41/00* (2006.01)

(52) U.S. Cl.
CPC ..... *E05B 65/1093* (2013.01); *E05B 41/00* (2013.01); *E05B 65/1046* (2013.01); *Y10T 70/7407* (2015.04); *Y10T 70/8027* (2015.04); *Y10T 70/8135* (2015.04); *Y10T 292/0908* (2015.04)

(58) Field of Classification Search
USPC ..... 292/92–94
See application file for complete search history.

(56) References Cited

U.S. PATENT DOCUMENTS 345,339 A 7/1886 Vail
419,607 A 1/1890 King
588,149 A 8/1897 Hinckley
(Continued)

FOREIGN PATENT DOCUMENTS

CH 379945 A 7/1964

OTHER PUBLICATIONS

Canadian Office Action; Canadian Intellectual Property Office; Canadian Patent Application No. 2,920,235; dated Feb. 20, 2017; 4 pages.

(Continued)

*Primary Examiner* — Carlos Lugo
(74) *Attorney, Agent, or Firm* — Taft Stettinius & Hollister LLP

(57) ABSTRACT

An exit device having a dogging mechanism assembly for providing a visual indication of the state or position of at least certain components of the exit device, such as, for example, a latch, drive rod, and/or a hook bracket. The dogging mechanism assembly includes a displaceable arm actuator mechanism that is coupled to the hook bracket, the hook bracket being adapted to lockingly engage the drive rod. The actuator arm mechanism is adapted to displace an indicator mechanism at least from a first indicator position to a second indicator position as the actuator arm mechanism is displaced to at least one of a first position and a second position. The indicator mechanism has one or more indicators that provide a visual indication of a state or position of a component of the exit device when the indicator mechanism is in at least one of a first and second indicator position.

20 Claims, 12 Drawing Sheets

(56) References Cited

U.S. PATENT DOCUMENTS

| | | | |
|---|---|---|---|
| 590,418 | A | 9/1897 | Langford |
| 747,252 | A | 12/1903 | Smith |
| 943,637 | A | 12/1909 | Schoell |
| 999,044 | A | 7/1911 | Kuster |
| 1,066,664 | A | 7/1913 | Senior |
| 1,081,190 | A | 12/1913 | Arita |
| 1,099,106 | A | 6/1914 | Wevat |
| 1,158,920 | A | 11/1915 | Hart et al. |
| 1,216,899 | A | 2/1917 | Weyer |
| 1,337,401 | A | 4/1920 | Heberling |
| 1,362,647 | A | 12/1920 | Stone et al. |
| 1,363,486 | A | 12/1920 | Stone |
| 1,529,766 | A | 3/1925 | Bina |
| 2,272,909 | A | 2/1942 | Fantl |
| 2,565,669 | A | 8/1951 | Smith |
| 3,304,756 | A | 2/1967 | Eads |
| 4,006,471 | A | 2/1977 | Pappas |
| 4,490,999 | A | 1/1985 | Castle et al. |
| 4,717,909 | A | 1/1988 | Davis |
| 5,927,765 | A | 7/1999 | Austin et al. |
| 7,571,694 | B2 | 8/2009 | Boemer |
| 7,614,265 | B2 | 11/2009 | Belden, Jr. et al. |
| 7,699,365 | B2 | 4/2010 | Liang et al. |
| 8,070,192 | B2 | 12/2011 | Tien |
| 8,419,088 | B2 | 4/2013 | Baic et al. |
| 8,915,523 | B2 | 12/2014 | Tillman et al. |
| 2004/0187533 | A1 | 9/2004 | Huang |
| 2011/0016938 | A1 | 1/2011 | Chi |

OTHER PUBLICATIONS

Canadian Office Action; Canadian Intellectual Property Office; Canadian Patent Application No. 2,920,235; dated Dec. 1, 2017; 4 pages.

Allegion—"Dogging Indicator Kit Installation Instructions"; Document No. 941256-00; Jan. 2014; US.

Allegion—"Classroom Security Indicator"; Document No. 009598; Feb. 2014; US.

Sargent Manufacturing Co., Inc.—"School Security Solutions"; Document No. 90770; Jul. 2014; US.

DOGGING SECURITY INDICATOR FOR EXIT DEVICE

CROSS-REFERENCE TO RELATED APPLICATIONS

The present application is a continuation of U.S. patent application Ser. No. 14/614,885 filed on Feb. 5, 2015 and issued as U.S. Pat. No. 9,945,158, the contents of which are hereby incorporated by reference in their entirety.

BACKGROUND

Embodiments of the present invention generally relate to exit devices. More particularly, but not exclusively, embodiments of the present invention relate to an exit device that includes a visual indication of a state of a dogging mechanism.

Dogging mechanisms have traditionally been utilized to retain or otherwise hold a latch in a retracted and/or extended position. For example, when a dogging mechanism holds a latch of an exit device in a refracted position, the door to which the exit device is attached may be operated in the push/pull mode. Moreover, when in the push/pull mode, separate operation of the exit device to retract the latch when opening the door may be unnecessary. Retention of the latch in a retracted position may subject components of the exit device to fewer cycles, and thereby minimize wear of such components and/or extend the operable life of those components. Further, retention of the of the latch in a refracted position by use of the dogging mechanism may enhance or facilitate quieter operation of the door, as the sounds associated with mechanical operation of components of the exit device for retraction of the latch may be eliminated and/or minimized.

The convenience associated with using dogging mechanisms however may present security concerns. For example, the ease at which dogging mechanisms can be operated and/or accessed may encourage illicit and/or unauthorized operation of the dogging mechanism. Additionally, instances in which the dogging mechanism has been improperly positioned to retain the latch in a retracted position may not necessarily be readily visually apparent. Further, the inability at times to readily visually detect whether the dogging mechanism is, or is not, retaining the latch in a retracted position without operation of the door and/or exit device may also be problematic, including, for example, during at least certain types of emergency situations, including, for example, emergency lockdown situations.

BRIEF SUMMARY

An aspect of the present invention is an apparatus for selectively restraining the axial displacement of a drive rod to retain a positon of a latch of an exit device. The apparatus may include an arm actuator mechanism and a hook bracket, the hook bracket being structured to be coupled to the arm actuator mechanism and to selectively lockingly engage the drive rod to prevent axial displacement of the drive rod. The apparatus may also include an indicator mechanism that is structured for engagement by the arm actuator mechanism, the engagement between the indicator mechanism and the arm actuator mechanism being structured to displace the indicator mechanism from a first indicator position to a second indicator position as the arm actuator mechanism is displaced from a first position to a second position. Additionally, the indicator mechanism may have one or more indicators that indicate a state of the drive rod when the indicator mechanism is in at least one of the first and second indicator positions.

Another aspect of the present invention is an apparatus for selectively restraining the axial displacement of a drive rod to retain a positon of a latch of an exit device. The apparatus includes an actuator arm mechanism and a hook bracket. The hook bracket may be coupled to the actuator arm mechanism, and may include a retention member that is adapted to selectively lockingly engage the drive rod to prevent axial displaced of the drive rod. Additionally, the hook bracket may be rotatably displaced with the rotational displacement of the actuator arm mechanism. The apparatus may also include an indicator assembly having an indicator mechanism and a housing. The indicator mechanism may be coupled to the housing, at least a portion of the indicator mechanism being rotatable about at least a portion of the housing. Further, the indicator mechanism may be displaced from a first indicator position to a second indicator position by the rotational displacement of the actuator arm mechanism from the first position to the second position. Additionally, the indicator mechanism may have one or more indicators that indicate a state of the latch when the indicator mechanism is in at least one of the first and second indicator positions.

Another aspect of the present invention is an exit device having a latch that is coupled to a drive rod, the latch being axially displaced between an extend position and a retracted positon by displacement of the drive rod. The exit device also includes a dogging mechanism assembly that has an arm actuator mechanism, a hook bracket, and an indicator assembly. The arm actuator mechanism is coupled to the hook bracket, with the arm actuator mechanism and the hook bracket being displaceable between a first position and a second position. Further, the hook bracket is adapted to lockingly engage the drive rod when the hook bracket is at the second position and the latch is at the retracted position. The actuator arm mechanism is adapted to displace an indicator mechanism of the indicator assembly from a first indicator position to a second indicator position as the actuator arm mechanism is displaced to at least one of the first and second positions. Additionally, the indicator mechanism has one or more indicators that indicate a position of the latch when the indicator mechanism is in at least one of the first and second indicator positions.

BRIEF DESCRIPTION OF THE DRAWINGS

The description herein makes reference to the accompanying figures wherein like reference numerals refer to like parts throughout the several views.

Figure 1:
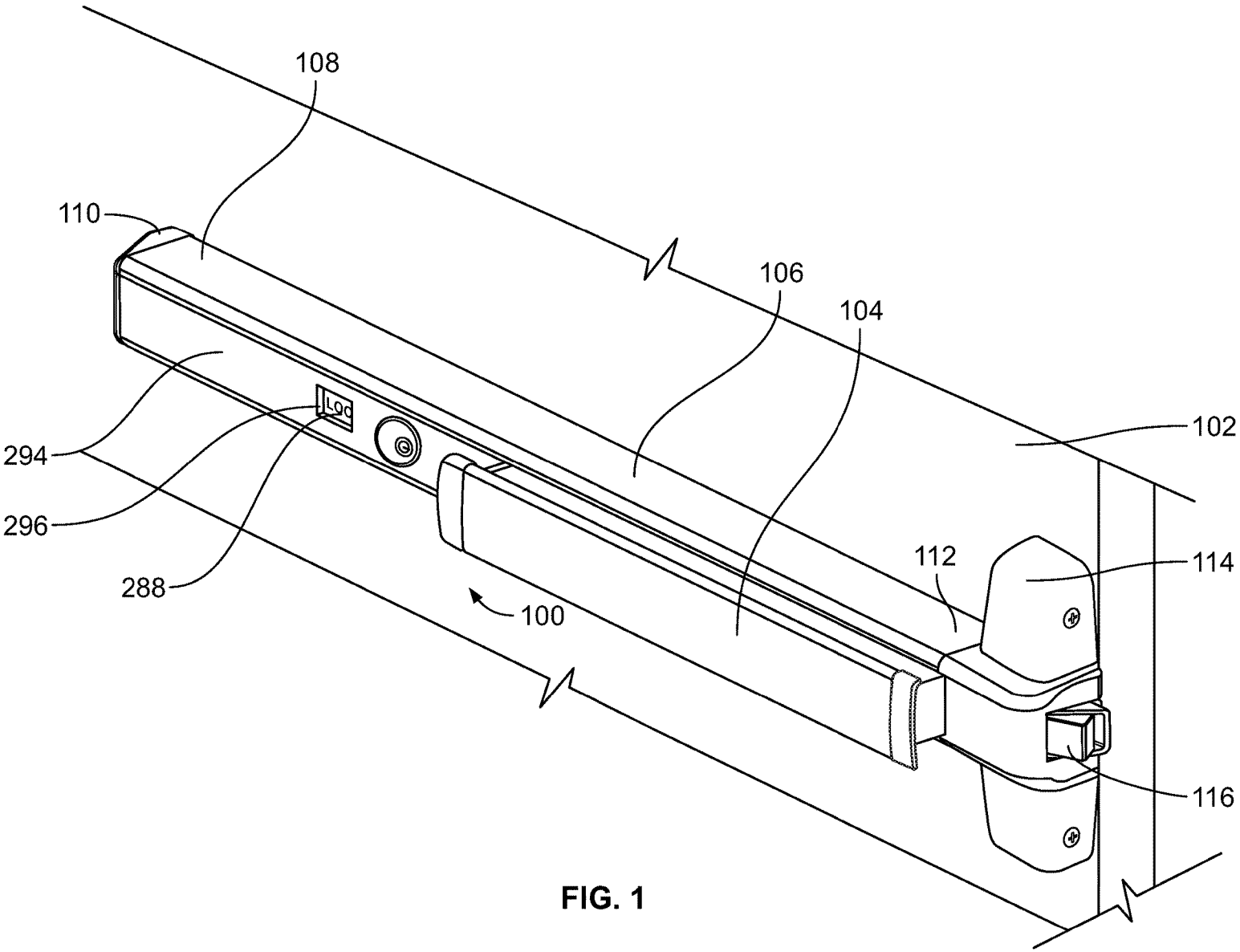
FIG. 1 illustrates a front side perspective view of an exit device operably attached to an entryway device according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a front side perspective view of an exit device 100 that is adapted to be operably attached to an entryway device 102, such as, for example, a door or gate, according to an embodiment of the present invention. According to the depicted embodiment, the exit device 100 includes a push bar or push pad 104 that may extend from a mechanism case 106. The mechanism case 106 may be directly or indirectly connected to the entryway device 102, such as, for example, by one or more mechanical fasteners, including, screws, bolts, and/or pins, among other connections. A distal end 108 of the mechanism case 106 may be secured to an end cap 110, while a proximal end 112 of the mechanism case 106 may be operably secured to a center case cover 114 and/or a center case assembly contained therein. The center case assembly includes a latch assembly having a latch 116. The latch assembly is operably connected to the push bar 104 such that, during typical usage, the operable displacement of the push bar 104 generally toward the mechanism case 106 may operate the latch assembly such that the latch 116 may be displaced from an extended, locked position to a retracted, unlocked position.

Figure 3:
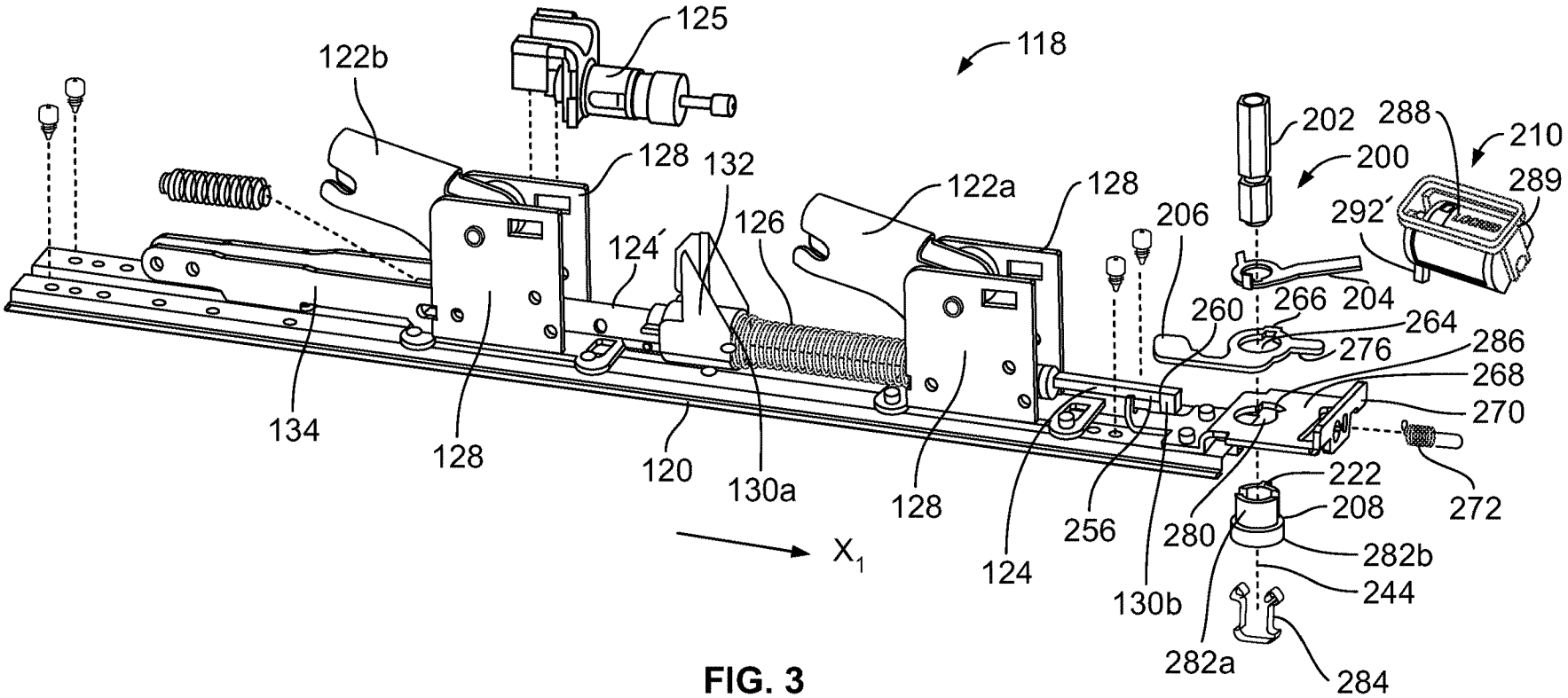
FIG. 3 illustrates an exploded view of a baseplate assembly and a portion of a dogging mechanism assembly according to an embodiment of the present invention.

Referencing FIG. 3, an interior portion of the exit device 100 houses at least a portion of a baseplate assembly 118 of the exit device 100. According to certain embodiments, the baseplate assembly 118 includes a baseplate 120, at least one bell crank 122*a*, 122*b*, a drive rod 124, a damper 125, and one or more biasing elements 126. The baseplate 120 may be coupled to the mechanism case 106 in a variety of manners, such as, for example, directly or indirectly via one or more mechanical fasteners, including, for example, screws, bolts, pin, and rivets, among other manners of attachment. The bell cranks 122*a*, 122*b* are pivotally secured to one or more side plates 128 that extend from the baseplate 126, with the side plates 128 being operably secured to the baseplate 120, such as, for example, via one or more mechanical fasteners.

When the latch 116 is in the extended, locked position, and the entryway device 102 is in a closed position in an entryway, at least a portion of the latch 116 may extend into the adjacent door frame, wall, and/or strike plate such that the extended latch 116 interferes with and/or prevents the entryway device 102 from being moved away from the closed position. When the latch 116 is in the extended, locked position, and the entryway device 102 is to be moved from the closed position to an open position, the exit device 100 may be operated to displace at least the latch 116 from the extended, locked position to a retracted, unlocked position. According to the illustrated embodiment, when the latch 116 is in the retracted position, the latch 116 may be positioned so as to not prevent the entryway device 102 from being moved to the open position relative to the entryway.

The drive rod 124 may have a first end 130*a* and a second end 130*b*. The first end 130*a* of the drive rod 124 may be coupled to the latch 116. For example, in the illustrated embodiment, the first end 130*a* of the drive rod 124 may be indirectly connected to the latch 116, such as, for example, via connections with a damper component 132 and one or more linkage members 134 of the baseplate assembly 118, including, for example, an action rod 124', among other connections or linkages. The second end 130*b* of the drive rod 124 may be adapted for engagement with a component of a dogging mechanism assembly 200, as discussed below.

Referencing FIG. 3, typically, during normal operating conditions, when the exit device 100 is not activated, such as when the push bar 104 has not been displaced toward the mechanism case 106, the bell cranks 122*a*, 122*b* are in a first, uncompressed position. When in the first, uncompressed position, the latch 116 is in the extended, locked position so as to lock a closed entryway device 102 in the closed position. Further, according to certain embodiments, the biasing element 126 may exert a force that biases the bell cranks 122*a*, 122*b* to the first, uncompressed position. For example, according to the illustrated embodiment, such biasing forces by at least the biasing element 126 may provide a pulling force that is translated to the bell crank 122*a*, 122*b*, such as, for example, by the drive rod 124 or components coupled to the drive rod 124, that bias the bell cranks 122*a*, 122*b* to the first, uncompressed position.

When the exit device 100 is to be activated, the push bar 104 is typically displaced or compressed toward the mechanism case 106. Such displacement of the push bar 104 may facilitate the pivotal displacement of the bell cranks 122*a*, 122, from the first, uncompressed position to a second, compressed position. Such pivotal displacement of the bell crank 122*a*, 122*b* may cause the bell crank 122*a*, 122*b* to exert a pulling force that overcomes the biasing force of the biasing element 126, and which is translated to drive rod 124 being axially displaced toward the dogging mechanism assembly 200, as indicated by arrow $x_1$ in FIG. 3. As the drive rod 124 is coupled to the latch 116, such displacement of the drive rod 124 toward the dogging mechanism 200 may also result in the latch 116 being pulled in a similar direction, and more specifically, the drive rod 124 being displaced from the extended, locked position to the retracted, unlocked position.

As shown in at least FIGS. 3-7, the dogging mechanism assembly 200 includes an actuator 202, an actuator arm mechanism 204, a hook bracket 206, a coupling 208, and an indicator assembly 210. According to the illustrated embodiment, the actuator arm mechanism 204 includes a body portion 212 and an arm portion 214. According to certain embodiments, the arm portion 214 may extend from a first end 216*a* of the body portion 212. The body portion 212 may also include an aperture 220 that extends from a first side 218*a* to a second side 218*a* of the body portion 212. The aperture 220 may have a variety of different shapes and sizes. Further, the aperture 220 may be sized to receive placement of at least a portion of the coupling 208. Further, the actuator arm mechanism 204 may be coupled to the coupling 208 such that rotational displacement of one of the actuator arm mechanism 204 and the coupling 208 results in the rotational displacement of the other of the actuator arm mechanism 204 and the coupling 208. As shown by at least FIGS. 3 and 4, according to the illustrated embodiment, the actuator arm mechanism 204 and coupling 208 may be operably coupled together via a key joint, such as by a key or projection 222 that extends from, or is operably engaged with, the coupling 208, and which extends into a slot or keyway 224 of the aperture 220 of the actuator arm mechanism 204. However, the actuator arm mechanism 204 and coupling 208 may be rotatably coupled to each other in a variety of other manners, including, for example, by one or more pins, among other connections.

The body portion 212 may also include first and second protrusions 226*a*, 226*b* that extend from the first side 218*a* of the body portion 212. While in the illustrated embodiment the first and second protrusions 226*a*, 226*b* and the arm portion 214 are generally on or in the vicinity of opposing ends first and second ends 216*a*, 216*b* of the body portion 212, the arm portion 214 and/or the first and second protrusions 226*a*, 226*b* may be located at a variety of other locations relative to the body portion 212, including, for example, at the same end 216*a*, 216*b* of the body portion 212. Further, according to certain embodiments, the arm portion 214 may comprise an extension of the body portion 212.

In the illustrated embodiment, the arm portion 214 may be coupled to the body portion 212 at a proximal end 228*a* of the arm portion 214. Further, the proximal end 228*a* of the arm portion 214 may or may not be co-planar with a distal end 228*b* of the arm portion 214. For example, according to certain embodiments, at least a portion of the arm portion 214 may angularly extend away from the body portion 212 and/or from other portions of the arm portion 214 so that the distal end 228*b* of the arm portion 214 is offset from, or non-planar to, the body portion 212 and/or the proximal end 228*a* of the arm portion 214. For example, as shown in at least FIG. 14, according to certain embodiments, first and third arm sections 230*a*, 230*c* of the arm portion 214 may extend along generally parallel longitudinal axes 232*a*, 232*c*, respectively, that are intersected by the longitudinal axis 202*b* of a second, connecting section 230*b* of the arm portion 214. Moreover, referencing FIG. 14, the second, connecting section 230*b* of the arm portion 214 may extend upwardly and outwardly from the first section 230*a* of the arm portion 214, or from the body portion 212, so that at least the second side 218*b* of the actuator arm mechanism 204 at the distal end 228*b* of the arm portion 214 is vertically offset (as indicated by the "V" direction in FIG. 14) from the portion of the second side 218*b* at the body portion 212 of the actuator arm mechanism 204. Similarly, the first side 218*b* at the distal end 228*b* of the arm portion 214 may also be offset (as indicated by the "V" direction in FIG. 14) from the portion of the first surface 218*a* at the body portion 212 of the actuator arm mechanism 204.

Figure 5A:
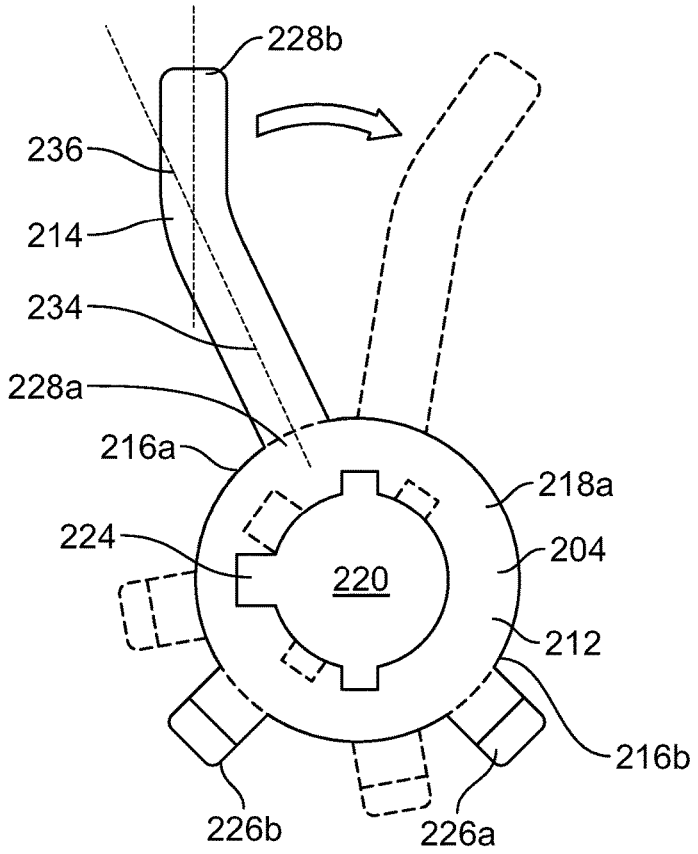
FIG. 5*a* illustrates a front view of an actuator arm mechanism of the dogging mechanism assembly illustrated in FIG. 4 in first and second positions.
Figure 5B:
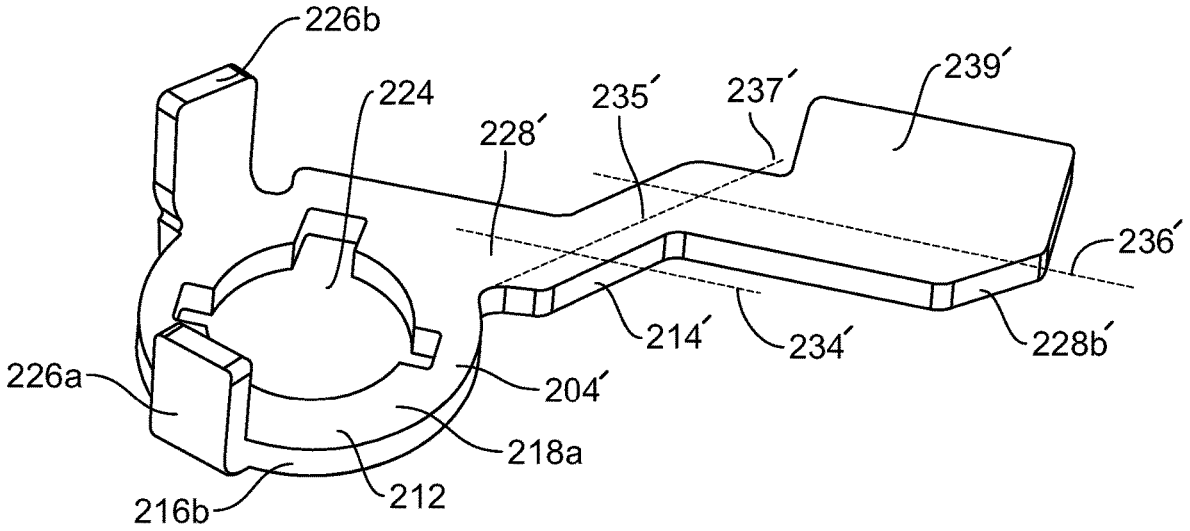
FIG. 5*b* illustrates a side perspective view of an actuator arm mechanism according to an illustrated embodiment of the present invention.

As shown in FIG. 5*a*, according to certain embodiments, at least a portion of the arm portion 214 may have a slight bend or curvature. For example, according to the illustrated embodiment, the arm portion 214 that is adjacent to the proximal end 228*a* may extend along a first longitudinal axis 234, while the arm portion 214 that is adjacent to the distal end 228*b* may extend along a second longitudinal axis 236 that is not parallel to the first longitudinal axis 234, with those portions of the arm portion 214 being joined together by a curved or bent segment of the arm portion 214. However, the arm portion 214 may have a variety of other shapes and configurations. For example, as shown in FIG. 5*b*, according to certain embodiments, the arm portion 214' that is adjacent to the proximal end 228*a*' may extend along a first longitudinal axis 234', while the arm portion 214' that is adjacent to the distal end 228*b*' may extend along a second longitudinal axis 236' that is parallel to, and offset from, the first longitudinal axis 234', with those portions of the arm portion 214 being joined together by an angled portion 235' of the arm portion 214' that extends along a third longitudinal axis 237' that intersects the first and second longitudinal axes 234', 236'. Additionally, according to certain embodiments, the arm portion 214' may include one or more extensions or projection 239' that are offset from a side(s) of the arm portion 214', and which are sized to engage the indicator assembly 210.

According to certain embodiments, the actuator 202 may be a shaft that is adapted for direct or indirect engagement with a tool that may be inserted into the dogging mechanism assembly 200, such as, for example, a hex tool or key, Allan wrench, socket, or screw driver, among other tools. For example, referencing FIG. 4, according to certain embodiments, the actuator 202 may be a dogging shaft 238 having opposing first and second ends 240*a*, 240*b*, the first end 240*a* being adapted to receive the insertion of a tool in an aperture 242 of the dogging shaft 238. Further, at least a portion of the second end 240*b* of the dogging shaft 238 may be adapted to matingly engage the coupling 208 such that the coupling 208 may be rotated via rotation of the dogging shaft 238 along an axis of rotation 244 of the dogging mechanism assembly 200. For example, in the illustrated embodiment, an outer wall 246 of the second end 240*b* of the dogging shaft 238 may have a hexagonal shape that mates with an hexagonal portion of an orifice 248 of the coupling 208. However, the dogging shaft 238 and the coupling 208 may have a variety of other mating shapes and configurations.

According to such an embodiment, the dogging shaft 238 may be rotated by rotational displacement of the tool. Thus, in an illustrated embodiment, when the tool is operably engaged with the dogging shaft 238, the dogging shaft 238 may be rotatably displaced by rotation or other manipulation of the tool. Further, the engagement of the dogging shaft 238 and the coupling 208, such as, for example, the engagement of external hexagon configuration of at least a portion of the dogging shaft 238 with a hex-shaped portion of the orifice 248 of the coupling 208, may allow the rotation of the dogging shaft 238 by rotation of the tool to also drive the rotational displacement of the coupling 208, as well as components that may also be engaged with the coupling 208, such as, for example, the hook bracket 206 and the arm actuator mechanism 204, as discussed below. Further, according to the illustrated embodiment, the actuator 202 and coupling 208 may rotate in the same direction as the tool is rotated. Thus, according to such an embodiment, the actuator 202 and the coupling 208 may be structured to be rotated in a first, unlocked direction, and a second, opposite or locked direction.

Figure 2:
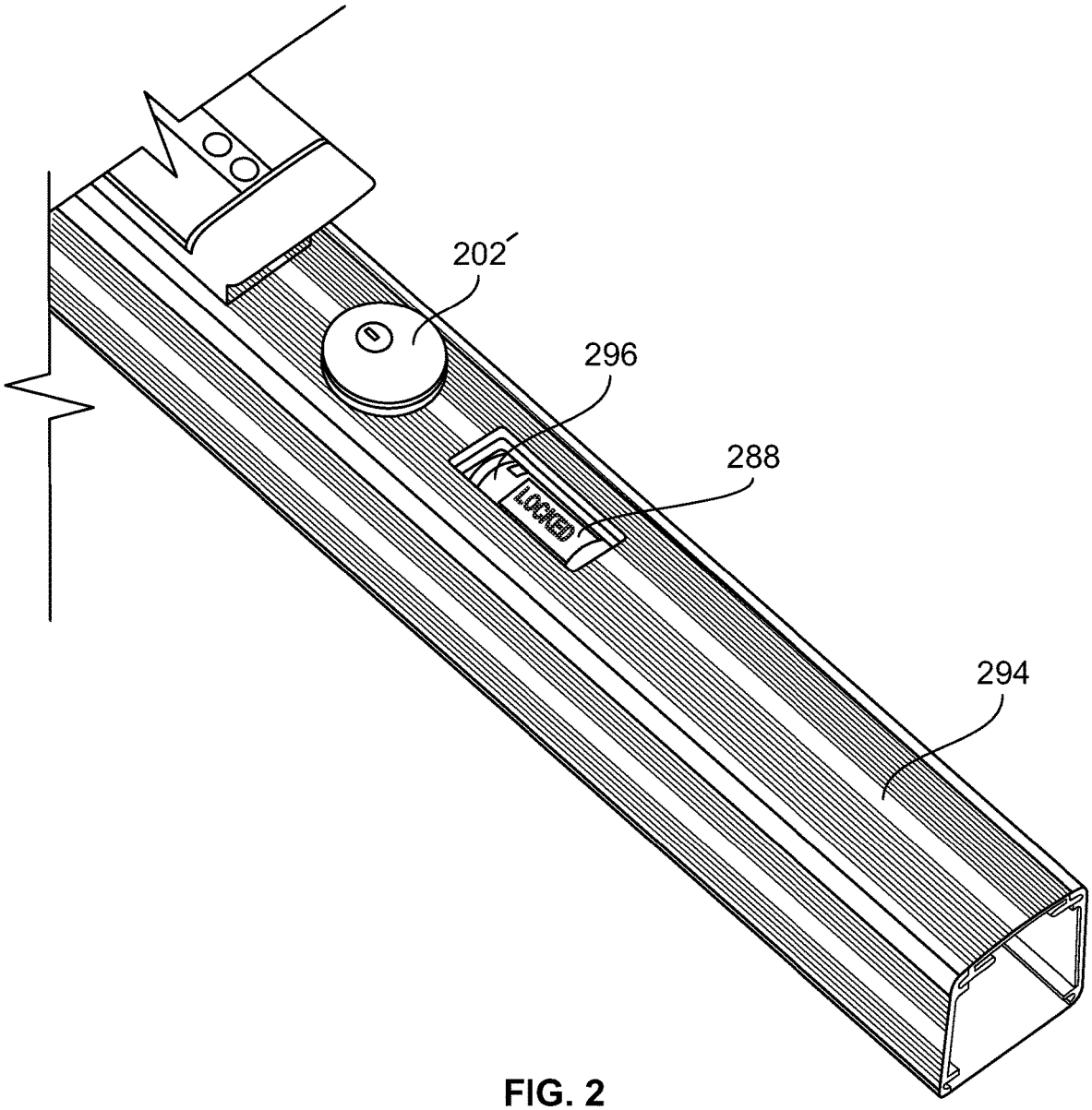
FIG. 2 illustrates a front perspective view of a portion of an exit device having a dogging mechanism assembly according to an embodiment of the present invention.
Figure 4:
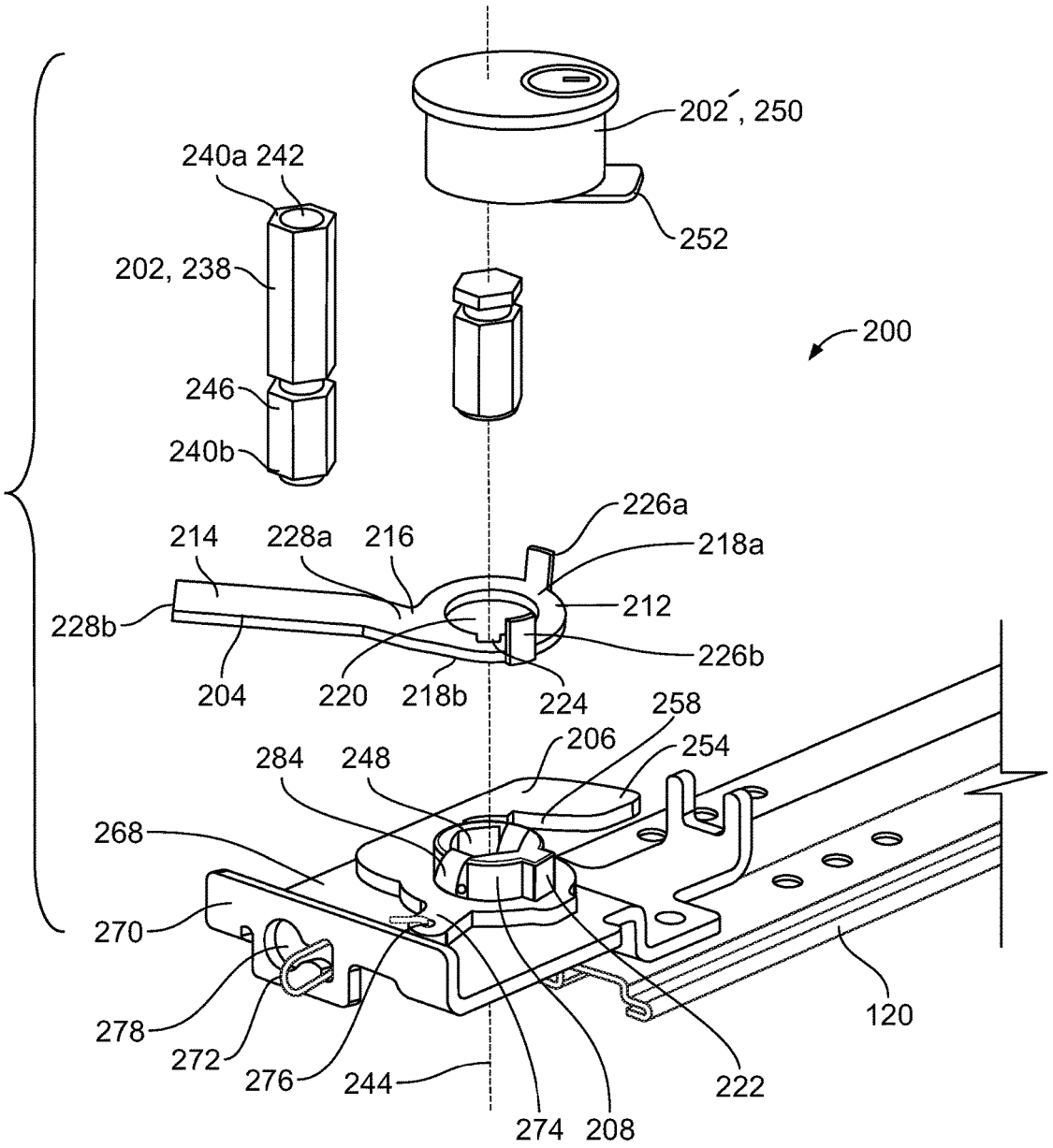
FIG. 4 illustrates an exploded view of a portion of a dogging mechanism according to an embodiment of the present invention.

Alternatively, according to other embodiments, the actuator 202' may be a cam mechanism 250, such as, for example, the cylindrical cam, as shown in FIGS. 1, 2, and 4. According to certain embodiments, the cam mechanism 250 includes a cam projection 252 that is structured to be rotatably displaced, by operation of the cam mechanism 250, into engagement with first and second protrusions 226*a*, 226*b* of the actuator arm mechanism 204. The cam mechanism 250 may be operated in a variety of different manners. For example, the cam mechanism 250 may be adapted to receive the insertion of a key, tool, or other object that may be at least partially rotated about the cam mechanism 250 to facilitate the rotational displacement of the cam projection 252. Further, according to certain embodiments, the cam mechanism 250 may include a lock that may be in a locked or unlocked condition. According to such embodiments, the cam projection 252 may be rotated by the insertion of a key into the cam mechanism 250 that has a configuration that may unlock the lock the cam mechanism 250.

According to certain embodiments, rotation of the key, tool, or object in a first, unlocked direction may translate into the cam projection 252 also being rotated in a first, unlocked direction and into engagement with the first protrusion 226*a* of the actuator arm mechanism 204. When engaged with the first protrusion 226*a*, rotation of the cam projection 252 in the first, unlocked direction may cause the cam projection 252 to exert a force against the first protrusion 226*a* that at least facilitates the rotational displacement of the actuator arm mechanism 204 in the first, unlocked direction. Conversely, when the cam projection 252 rotates in an opposite, second, locked direction and/or is in engagement with the second protrusion 226*b*, the cam projection 252 may exert a force against the second protrusion 226*b* that at least facilitates the rotation of the actuator arm mechanism 204 in the second, locked direction. Further, as previously discussed, according to certain embodiments, actuator arm mechanism 204 may matingly engage, or otherwise be coupled to, the coupling 208, such as, for example, by a key joint, such that rotation of the actuator arm mechanism 204 via displacement of the cam projection 252 is translated into rotational displacement of the coupling 208, and the associated rotational displacement of at least certain components of dogging mechanism assembly 300 that are coupled to the coupling 208, such as, for example, the hook bracket 206.

The retention member 254 may have a variety of different shapes and sizes. For example, according to the illustrated embodiment, the retention member 254 may be structured to be received in a recess 256 at the second end 130*b* of the drive rod 124 such that a retention edge 258 of the retention member 254 abuts a wall or edge 260 of the drive rod 124 in a manner that prevents, or otherwise interferes with, the axial displacement of the drive rod 124 in at least one direction, such as, for example, in a direction generally toward the latch 116. Further, according to certain embodiments, the retention edge 258 of the retention member 254 may at least partially extend around a cavity 262 of the retention member 254 such that a portion of the retention member 254 has a generally hook-shaped configuration. The cavity 262 of the retention member 254 may be shaped or sized to prevent other portions of the retention member 254 from interfering with at least a portion of the retention edge 258 of the retention member 254 from being able to be positioned about the drive rod 124 to abut or otherwise lockingly engage the wall or edge 260 of the drive rod 124 in a manner that prevents or limits the axial displacement of the drive rod 124.

Similar to the aperture 220 of the actuator arm mechanism 204, the hook bracket 206 includes a bracket aperture 264 that extends through the hook bracket 206. The bracket aperture 264 may have a variety of shapes and sizes. Further, the bracket aperture 264 may be sized to receive at least a portion of the coupling 208. Additionally, as previously discussed, the hook bracket 206 may also be coupled to the coupling 208 such that rotational displacement of one of the actuator arm mechanism 204 and the hook bracket 206 in the first, unlocked direction or second, locked direction results in similar rotational displacement of the other of the actuator arm mechanism 204 and the hook bracket 206. For example, as shown by at least FIGS. 3 and 4, according to the illustrated embodiment, similar to the actuator arm mechanism 204, the hook bracket 206 and the coupling 208 may be operably connected by a key joint, such as by a key or projection 222 that extends from, or is operably engaged with, the coupling 208, and which extends into a slot or keyway 266 of the bracket aperture 264 of the hook bracket 206. However, the hook bracket 206 and coupling 208 may also be coupled to each other in a variety of other manners, including, for example, by one or more pins, among other connections, or may both be part of a single, monolithic structure. Additionally, while the hook bracket 206 and actuator arm mechanism 204 are illustrated in the depicted embodiment as separate components, according to other embodiments, the hook bracket 206, including the retention member 254 of the hook bracket 206, may be part of the actuator arm mechanism 204. Such a structure may also include the coupling 208. Alternatively, according to other embodiments, the actuator arm mechanism 204 and the coupling 208 may be part of a single, monolithic structure.

When in a locked state, the dogging mechanism assembly 200 may prevent the axial displacement of the drive rod 124, which, again, may prevent the associated axial displacement of the latch 116. For example, according to certain embodiments, when the dogging mechanism assembly 200 is in a locked state, the drive rod 124 may be engaged by the retention member 254 of the hook bracket 206 such that the latch 116 may not be displaced from the retracted, unlocked position. Conversely, when the dogging mechanism assembly 200 is in the unlocked state, the hook bracket 206 may be positioned so as to not interfere or prevent the axial displacement of the drive rod 124. Moreover, in the illustrated embodiment, when the dogging mechanism assembly 200 is in the unlocked position, the dogging mechanism assembly 200 may be disengaged with from the drive rod 124 such that the dogging mechanism assembly 200 does not prevent the drive rod 124 from being positioned in a manner that allows the latch 116 to be in the extended, locked position.

As shown by at least FIG. 3, in the illustrated embodiment, the hook bracket 206 may be positioned between the actuator arm mechanism 204 and an upper surface 268 of a support bracket 270. Further, the hook bracket 206 may be connected to a biasing element 272 that is attached to the support bracket 270. For example, according to the depicted embodiment, the hook bracket 206 may include a projection 274 that includes an orifice 276 that receives the insertion of at least a first end of the biasing element 272, a second, opposing end is received in an orifice 278 of the support bracket 270. The biasing element 272 may be adapted and/or positioned to bias the positioning of at least the hook bracket 206, such as, for example, biasing the hook bracket 206 at a locked or unlocked position. According to the illustrated embodiment, the biasing element 272 may bias the hook bracket 206 to an unlocked position, wherein the hook bracket does not interfere with the axial displacement of the drive rod 124. However, as previously discussed, according to the illustrated embodiment, the rotational position of the hook bracket 206 may, through the engagement with the coupling 208, may influence, or be influenced by, the rotational position of both the coupling 208 and the actuator arm mechanism 204. Thus, the biasing element 272 may also bias, directly or indirectly, the position of the coupling 208 and actuator arm mechanism 204.

According to the illustrated embodiment, the support bracket 270 may also include an opening 280 that extends from the upper surface 268 of the support bracket 270 and through the support bracket 270. The opening 280 may be sized to receive the rotatable placement of at least a portion of the coupling 208. According to the illustrated embodiment, the coupling 208 may include a first portion 282*a* and a second portion 282*b*, the first portion 282*a* having an outer size or shape that is different than the second portion 282*b* and is configured to be received in the opening 280. For example, as illustrated by at least FIGS. 3 and 4, the first portion and second portions 282*a*, 282*b* of the coupling 208 may have a cylindrical configuration, with the outer diameter of the first portion 282*a* being smaller than the outer diameter of the second portion 282*b*. According to such an embodiment, the outer diameter of the first portion 282*a* may be sized to be received in the opening 280 of the support bracket 270, while the outer diameter of the second portion 282*b* may be too large to be received in the opening 280. Additionally, the coupling 208 may be secured in the opening 280 by a fastener, such as, for example, by a retention clip 284. Further, the opening 280 in the support bracket 270 may include a slot 286 that is sized to accommodate and/or limit the rotational displacement of the key or projection 222 that extends from, or is operably engaged with, the coupling 208. By limiting the extent to which the coupling 208 may be rotatably displaced, the slot 286 of the support bracket 270 may also limit the extent to which at least certain components of the dogging mechanism assembly 200, such as, for example, the coupling 208, hook bracket 206, and the actuator arm mechanism 204 are also rotatably displaced.

As shown in at least FIGS. 3 and 6-15, the dogging mechanism assembly 200 also includes an indicator assembly 210 that comprises an indicator mechanism 288 and a housing 289. According to the illustrated embodiment, the indicator mechanism 288 has a body section 290 and an engagement member 292, 292'. As shown in at least FIGS. 9-12 14, and 15 according to certain embodiments, the engagement member 292' may extend from the body section 290 and is adapted for engagement with/by the arm portion 214 of the actuator arm mechanism 204. However, according to other embodiments, as shown, for example, in at least FIG. 16, at least a portion of a bottom or rear section 291 of the body section 290 may provide the engagement member 292. For example, according to the illustrated embodiment, as the actuator arm mechanism 204 is rotated in the second, locked direction by rotation of the actuator arm mechanism 204 about the axis of rotation 244 of the dogging mechanism assembly 200, the arm portion 214 of the actuator arm mechanism 204 may, according to certain embodiments, be brought into contact with the engagement member 292, 292' and/or exert a force upon the engagement member 292, 292' that displaces the body section 290 of the indicator mechanism 288 from a first indicator position to a second indicator position, as discussed below. Alternatively, as the actuator arm mechanism 204 is rotated in the second, locked direction by rotation of the actuator arm mechanism 204, the arm portion 214 may be displaced to a position that does not prevent a biasing element 316 of the indicator assembly 210 from providing a force that displaces the indicator mechanism 288 to the second indicator position.

The position of the indicator mechanism 288 may correspond to the position or state of the dogging mechanism assembly 200. For example, according to the illustrated embodiment, the body section 290 may be in the first indicator position when the dogging mechanism assembly 200 is in a first, unlocked position, and in a second indicator position when the dogging mechanism assembly 200 is in the second, locked position. Additionally, position or status indicator(s) or indicium may be positioned at one or more areas of the body section 290. Such indicium or indicia may provide a visual indication of whether the dogging mechanism assembly 200 is at the first, unlocked positon, or the second, locked position, and, more specifically, whether the dogging mechanism assembly 200 is, or is not, positioned to prevent axial displacement of at least the drive rod 124. Accordingly, such indicia or indicium may provide a visual indication of whether the latch bolt 116 is, or is not, in an extended, locked position. The indicium or indicia on the body section 290 may be visually accessible on or through at least a portion of the exit device 100, such as, for example, through an adjacent case cover 294. For example, according to the illustrated embodiment, the exit device 100 may include an opening or window 296 that permits visual access of at least indicium or indicia on a first portion 298*a* of the body section 290 when the body section 290 is in the first indicator position and/or visual access of at least indicium or indicia on a second portion 298*b* of the body section 290 when the body section 290 is in the second indicator position, as illustrated in at least FIGS. 1, 2, 9, and 11. A variety of different types of indicium or indicia may be employed, including, for example, words such as, but is not limited to, "LOCKED" and "UNLOCKED", and/or symbols representative of a locked or unlocked state or position of one or more components of the exit device 100, such as, for example, the dogging mechanism assembly 200 and/or the latch 116. For example, as indicated by at least FIGS. 12 and 14, according to the illustrated embodiment, when the body section 290 is in the first indicator position, and thus the dogging mechanism assembly 200 is in the first, unlocked position, the first portion 298*a* of the body section 290 may be positioned such that at least the word "UNLOCKED" is viewable through the opening or window 296 in the adjacent case cover 294. Conversely, as indicated by at least FIGS. 13 and 15, when the body section 290 is in the second indicator position, and thus the dogging mechanism assembly 200 is in the second, locked position, the second portion 298*b* of the body section 290 may be positioned such that at least the word "LOCKED" is viewable through the opening or window 296 in the case cover 294.

The indicator mechanism 288 may have a variety of different shapes and sizes. For example, in the depicted embodiment, the indicator mechanism 288 has a barrel or partial cylindrical shape, as shown, for example, in at least FIGS. 7, 9, 14, 15 and 16. According to another embodiment, the indicator mechanism 288 may be an axially slideable or displaceable plate. According to such an embodiment, different portions of the plate may have different indicium or indicia that, again, correspond to the position or state of at least a portion of the components of the exit device 100, such as, for example, the dogging mechanism assembly 200 and/or the latch 116.

Figure 14:
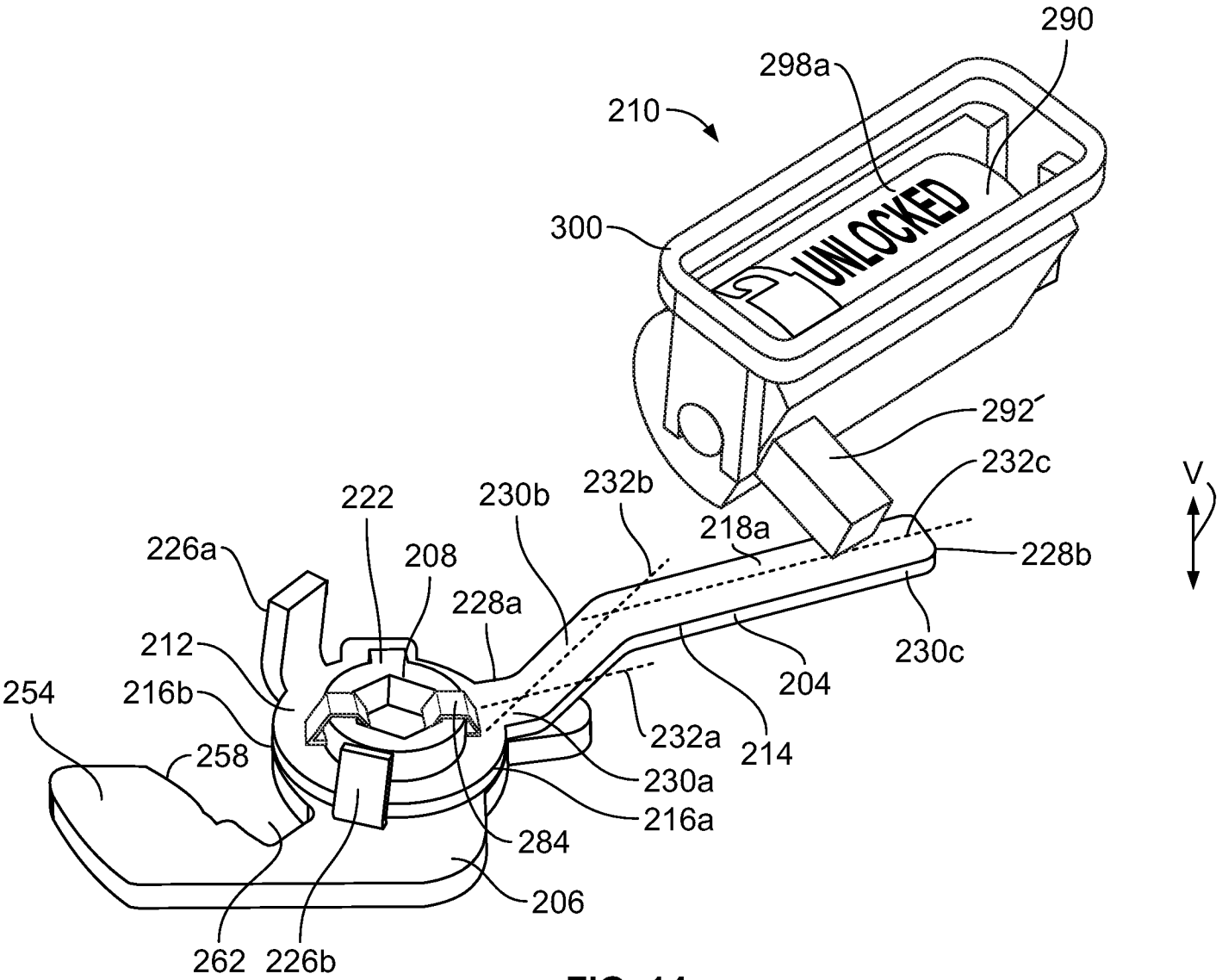
FIG. 14 illustrates a side perspective view of a portion of a dogging mechanism assembly in a first, unlocked position and an indicator mechanism in a first indicator position according to an illustrated embodiment of the present invention.

The housing 289 may include one or more sidewalls 300 that generally define at least a portion of an inner region 302 of the housing 289. The inner region 302 may be sized to accommodate the rotatable displacement of at least a portion of the body section 290 of the indicator mechanism 288 within at least a portion of the inner region 302. In the illustrated embodiment, the sidewall 300 includes an upper portion 304 and opposing first and second leg portions 306*a*, 306*b*. The first and second leg portions 306*a*, 306*b* may extend from opposing sides of the sidewall 300 of the housing 289 and may each include an opening 308*a*, 308*b* that is adapted to receive the insertion of an adjacent shaft portion 310*a*, 310*b* of the indicator mechanism 288. Moreover, the shaft portions 310*a*, 310*b* may be retained within, and at least partially rotated about, the openings 308*a*, 308*b*. Further, as illustrated in FIG. 14, according to certain embodiments, the indicator mechanism 288 may be at least partially rotated about the housing 289 along an indicator axis 312 that is generally perpendicular with, although not necessarily intersecting, the axis of rotation 244 of the dogging mechanism assembly 200.

As shown in FIGS. 6, 8, 10, 11, and 16, according to certain embodiments, the housing 289 may also include a lens portion 314 that may be secured within, on, or about the opening or window 296 of the case cover 294. According to certain embodiments, the lens portion 314 may be constructed from a relatively transparent material such that the lens portion 314 provides little, if any, interference with the ability to view the indicium or indicia on the body section 290 through the opening or window 296. Further, according to certain embodiments, the lens portion 314 may be adapted to at least assist in securing the indicator assembly 210 to the case cover 294 and/or may be part of the housing 289. Alternatively, the indicator assembly 210 may be coupled to a variety of other portions of the exit device 100, including, for example the baseplate 120, dogging mechanism assembly 200, and/or a latch assembly by one or more mechanical fasteners or connections, such as, for example, a screw, bolt, pin, interference fit, or threaded connection, among other fasteners and connections.

Figure 8:
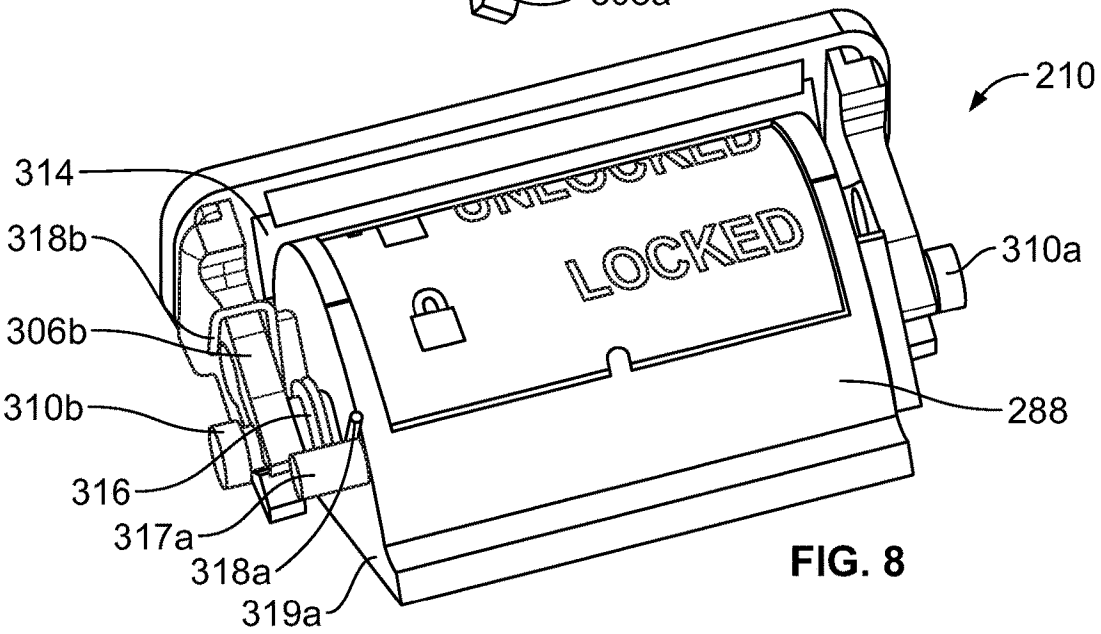
FIG. 8 illustrates a perspective view of an indicator assembly of a dogging mechanism assembly according to an embodiment of the present invention.
Figure 11:
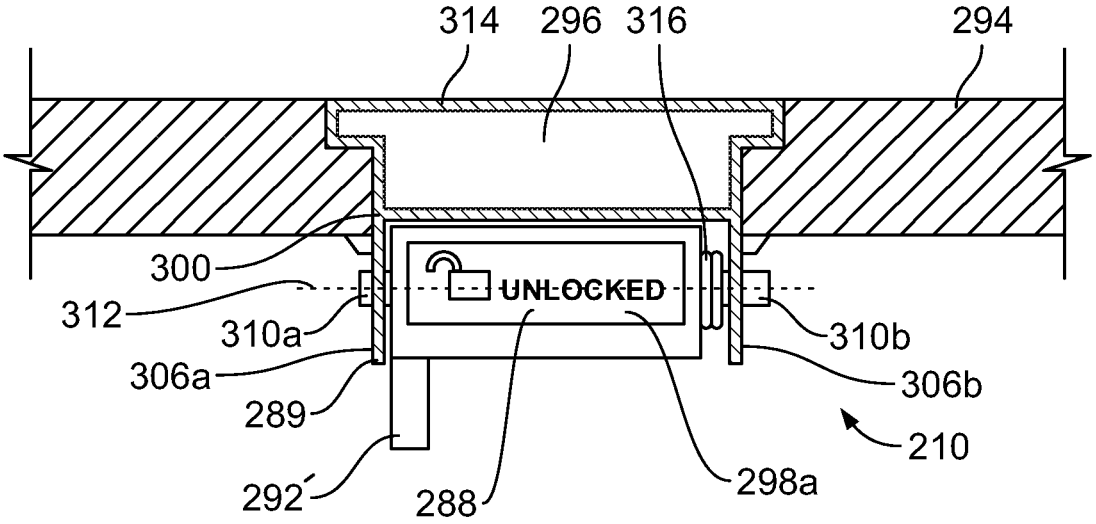

The indicator assembly 210 may also include a biasing element 316 that biases the indicator mechanism 288 in or toward the first indicator position or the second indicator position. According to certain embodiments, the biasing element 316 may be a spring, such as, for example, a torsion spring, as shown in FIGS. 8 and 11. According to an exemplary embodiment, a first end 318*a* of the biasing element 316 may operably abut against a portion of the body section 290 of the indicator mechanism 288, such as, for example, against a post 317*a* that extends from the body section 290, while a second end 318*b* of the biasing element 316 abuts against another component of the exit device 100, such as, for example, the housing 289 of the indicator assembly 210.

Figure 7:
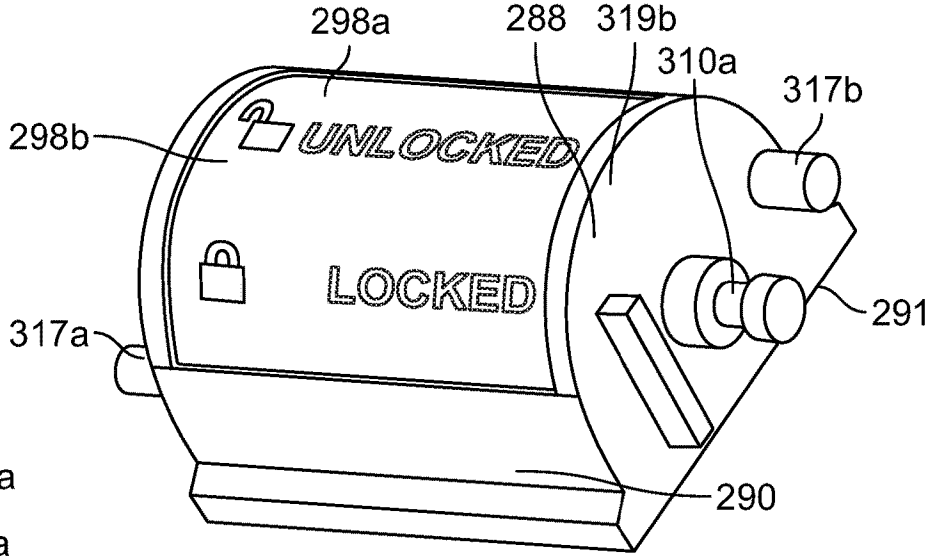
FIG. 7 illustrates a perspective view of an embodiment of an indicator mechanism for an indicator assembly of a dogging mechanism assembly according to an embodiment of the present invention.
Figure 6:
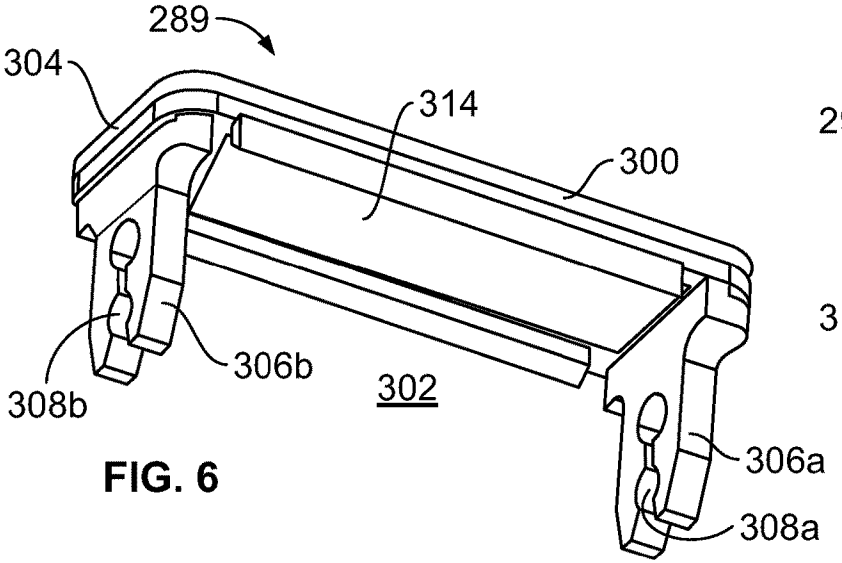
FIG. 6 illustrates a perspective view of a housing for an indicator assembly of a dogging mechanism assembly according to an embodiment of the present invention.
Figure 16:
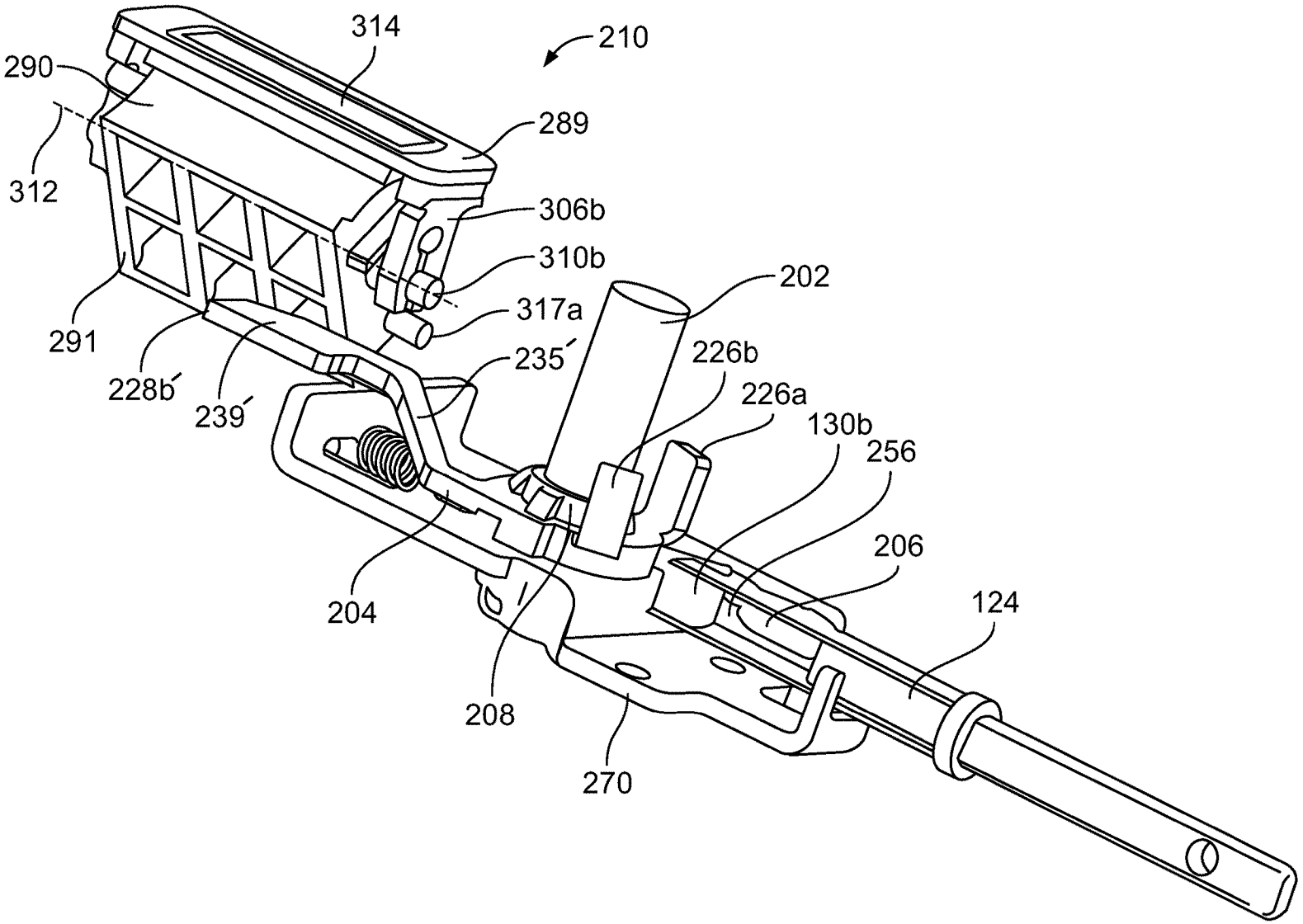
FIG. 16 illustrates a side perspective view of a portion of a dogging mechanism assembly according to an illustrated embodiment of the present invention.

As shown in at least FIGS. 7, 8, and 16, the indicator mechanism 288 may also include one or more posts 317*a*, 318*a* that extend from first and/or second sidewalls 319*a*, 319*b* of the indicator mechanism 288. The posts 317*a*, 317*b* may be positioned and/or configured to limit rotational displacement of the indicator mechanism 288 so that the indicator mechanism 288 is not rotatably displaced beyond a position in which indicia on the body section 290 is viewable through the lens portion 314, or associated opening, of the housing 289. In an illustrated embodiment, a first post 317*a* extends from a first sidewall 319*a* of the indicator mechanism 288 and is in general proximity to one of the first and second body portions 298*a*, 298*b* of the body section 290, while a second post 317*b* extends from a second sidewall 319*b* and in general proximity to the other of the first and second body portions 298*a*, 298*b*.

For example, referencing FIGS. 7 and 8, according to certain embodiments, when the indicator mechanism 288 is rotated in a first direction toward the first or second indicator positon, the first post 317*a* may be rotated toward, and eventually against, the adjacent leg portion 306*b* of the housing 289. In such a situation, the engagement or abutment of the first post 317*a* with/against the adjacent leg portion 306*b* of the housing 289 may prevent further rotational displacement of the indication mechanism 288 in the first direction. Additionally, the position of the indicator mechanism 288 when the first post 317*a* engages/abuts the leg portion 306*b* may correspond to one of the first or second indicator positions. Conversely, when the indicator mechanism 288 is rotatably displaced in an opposite, second direction, the second post 317*b* may be positioned to engage/abut the other leg portion 306*a* when the indicator mechanism 288 reaches the other of the first and second indicator positions, and thereby prevent further displacement of the indicator mechanism 288 in the second direction.

Figure 12:
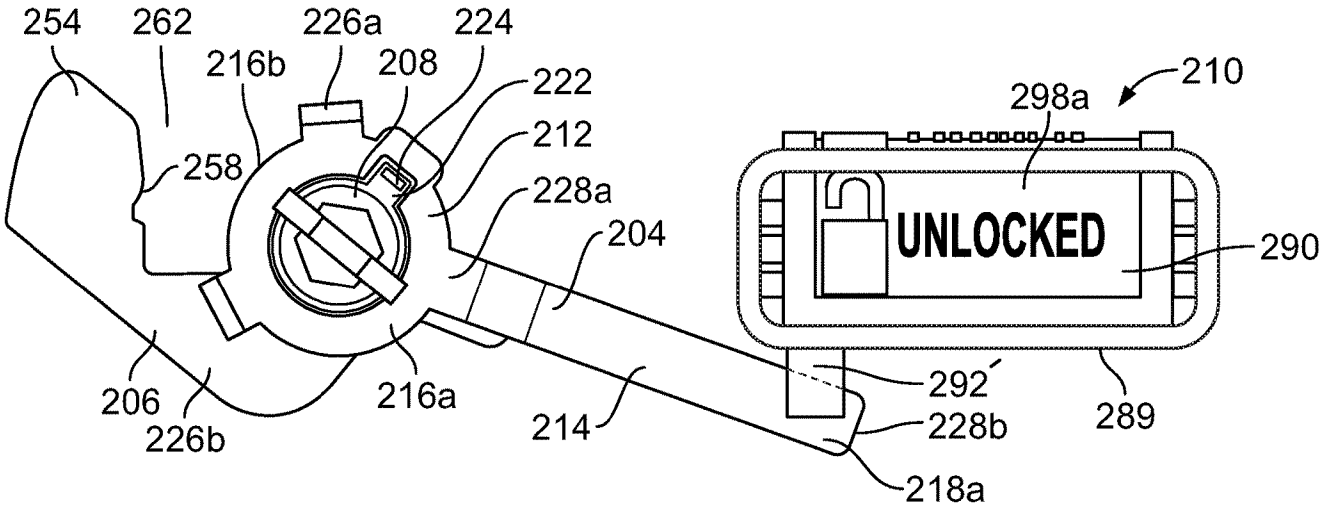
FIG. 12 illustrates a front view of a portion of a dogging mechanism assembly in a first, unlocked position and an indicator mechanism in a first indicator position according to an illustrated embodiment of the present invention.

Referencing FIGS. 12-15, according to certain embodiments in which the dogging mechanism assembly 200 is utilized to at least assist in retaining the latch 116 in a retracted, unlocked position, when the dogging mechanism assembly 200 is not activated, and therefore is at the first, unlocked position, the arm portion 214 of the actuator arm mechanism 204 may be in a first position wherein the arm portion 214 is engaged with the engagement member 292' of the indicator mechanism 288, as shown in FIGS. 12 and 14. Such engagement of the arm portion 214 of the actuator arm mechanism 204 with the engagement member 292' may position the indicator mechanism 288 at the first indicator position such that indicia on the first portion 298*a* of the body section 290, such as the word "UNLOCKED" and a symbol indicating an unlocked lock, may be viewable through the opening or window 296 in the case cover 294. Further, such positioning of the arm portion 214 of the actuator arm mechanism 204 may overcome the biasing force of the biasing element 316, which, according to such an embodiment, may be adapted to bias the indicator mechanism 288 to or toward the second indicator position.

According to such an embodiment, when the latch 116 is to be retained by the dogging mechanism assembly 200 in the retraced, unlocked position, the push bar 104 may be actuated to axially displace the drive rod 124 in a direction generally toward the dogging mechanism assembly 200. Such displacement of the drive rod 124 to may push or pull the latch 116 from the extended, locked position, to the retracted, unlocked position. With the drive rod 124 displaced, the actuator 202, 202' of the dogging mechanism assembly 200 may be rotatably displace in the second, locked direction, which may be translated into the rotational displacement of the coupling 208, hook bracket 206, and actuator arm mechanism 204 in the second, locked direction, as previously discussed. Further, as also, previously discussed, such rotational displacement of at least the actuator 202, 202' may translate into the retention member 254 of the hook bracket 206 being moved toward and into a locking engagement with the second end 130*b* of the drive rod 124 so as to generally prevent the drive rod 124, and thus the latch 116, from being axially displaced from their respective retracted, unlocked positions.

Figure 13:
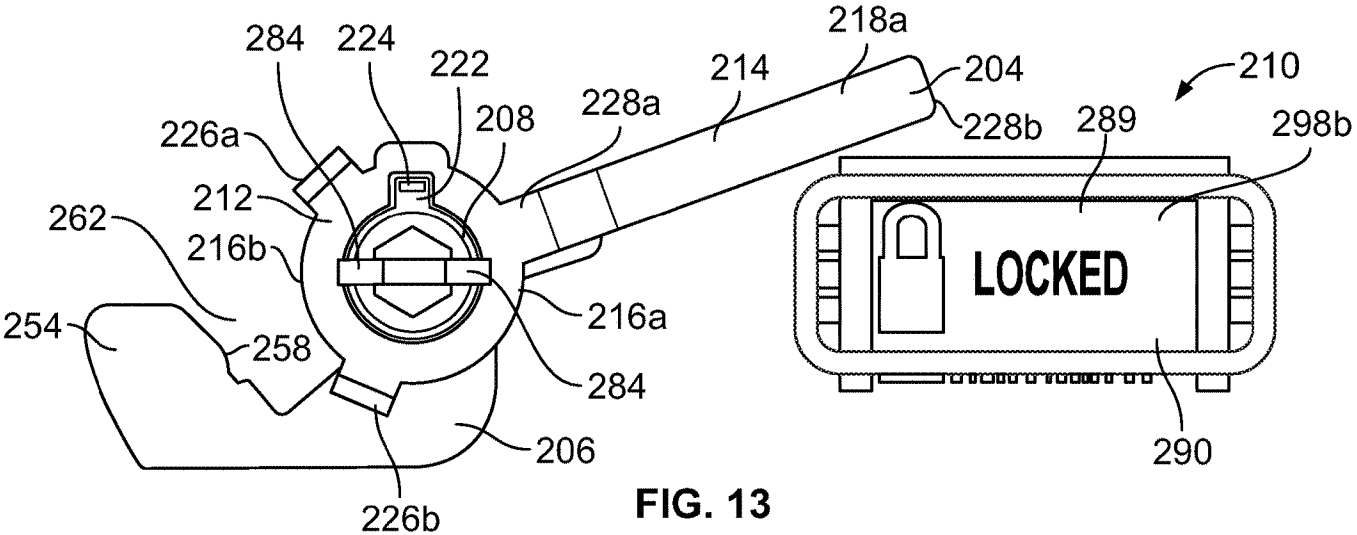
FIG. 13 illustrates a front view of a portion of a dogging mechanism assembly in a second, locked position and an indicator mechanism in a second indicator position according to an illustrated embodiment of the present invention.
Figure 15:
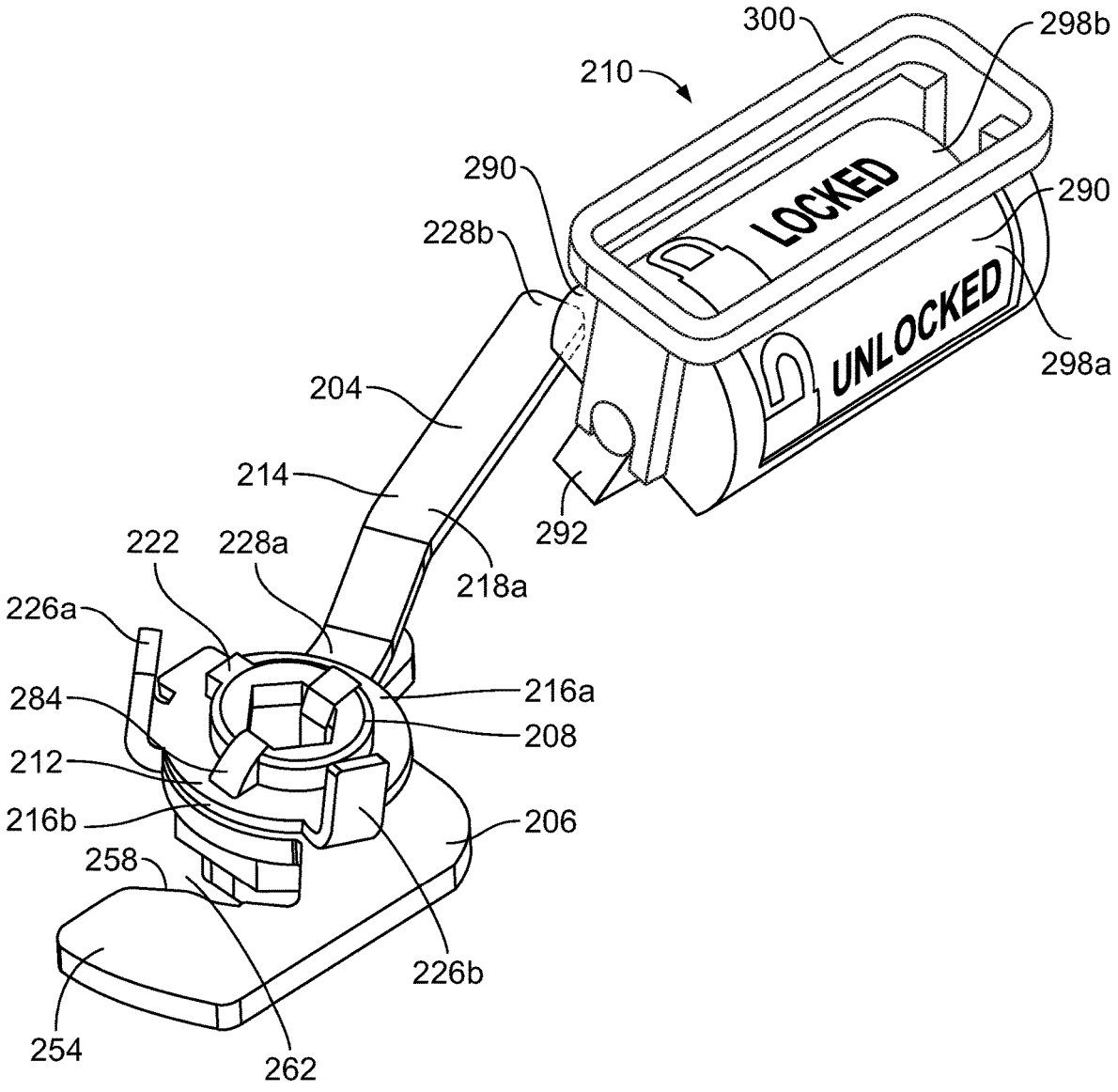
FIG. 15 illustrates a side perspective view of a portion of a dogging mechanism assembly in a second, locked position and an indicator mechanism in a second indicator position according to an illustrated embodiment of the present invention.

According to the embodiment illustrated in FIGS. 12-15, as the retention member 254 of the hook bracket 206 is moved toward locking engagement with the second end 130*b* of the drive rod 124, and the arm portion 214 of the actuator arm mechanism 204 is displaced in the second, locked direction away from the first position and toward a second position, the biasing force provided by the biasing element 316 of the indicator assembly 210 may displace the indicator mechanism 288 from the first indicator position and to the second indicator position. As shown in FIGS. 13 and 15, according to certain embodiments, when the arm portion 214 of the actuator arm mechanism 204 is at the second position, the arm portion 214 may be at a location that does not prevent the biasing element 316 of the indicator assembly 210 from providing a biasing force that places the indicator mechanism 288 at the second indicator position. More specifically, according to the illustrated embodiment, the biasing element 316 may provide a force that, as the arm portion 214 is displaced to the second position, causes the indicator mechanism 298 to rotate about the indicator axis 312 from the first indicator position to the second indicator position.

Further, according to certain embodiments, when the arm portion 214 of the actuator arm mechanism 204 is at the second position, the arm portion 214 may be disengaged from, or have minimal engagement with, the engagement member 292' of the indicator mechanism 288. Additionally, as shown in at least FIGS. 13 and 15, with the indicator mechanism 288 at the second indicator position, indicia on the second portion 298*b* of the body section 290, such as the word "LOCKED" and a symbol representing a locked lock, may be viewable through the opening or window 296 in the case cover 294.

When the dogging mechanism assembly 200 is to no longer retain the drive rod 124, and thus the latch 116, in their retracted, unlocked positions, the actuator 202, 202' may be rotated in the first, unlocked direction. Again, such rotational displacement of the actuator 202, 202' may translated into rotational displacement of the coupling 208, hook bracket 206, and actuator arm mechanism 204 in the first, unlocked direction, as previously discussed. As also, previously discussed, such rotational displacement may translate into the retention member 254 of the hook bracket 206 being released from the locking engagement with the second end 130*b* of the drive rod 124. With the release of the locking engagement between the dogging mechanism assembly 200 and the drive rod 124, the dogging mechanism assembly 200 may no longer retain the drive rod 124, and thus the latch 116, in their respective retracted, unlocked positions.

According to the embodiment illustrated in FIG. 12-15, as the actuator arm mechanism 204 is rotated in the first, unlocked direction, the arm portion 214 of the actuator arm mechanism may be displaced from the second position, as shown in FIGS. 13 and 15, to the first position, as shown in FIGS. 12 and 14. According to such an embodiment, as the actuator arm mechanism 204 is displaced in the first, unlocked direction, the arm portion 214 of the actuator arm mechanism 204 may exert a force against the engagement member 292' of the indicator mechanism 288 that overcomes the biasing force of the biasing element. Thus, as the arm portion 214 is displaced toward the first position, the arm portion 214 may exert a force against the engagement member 292' that results in the rotation of the actuator arm mechanism 204 about the indicator axis 312 from the second indicator position to the first indicator position. With the indicator mechanism 288 returned to the first indicator position, indicium or indicia on the first portion 298*a* of the body section 290 may again be viewable through the opening or window 296 in the case cover 294.

Figure 9:
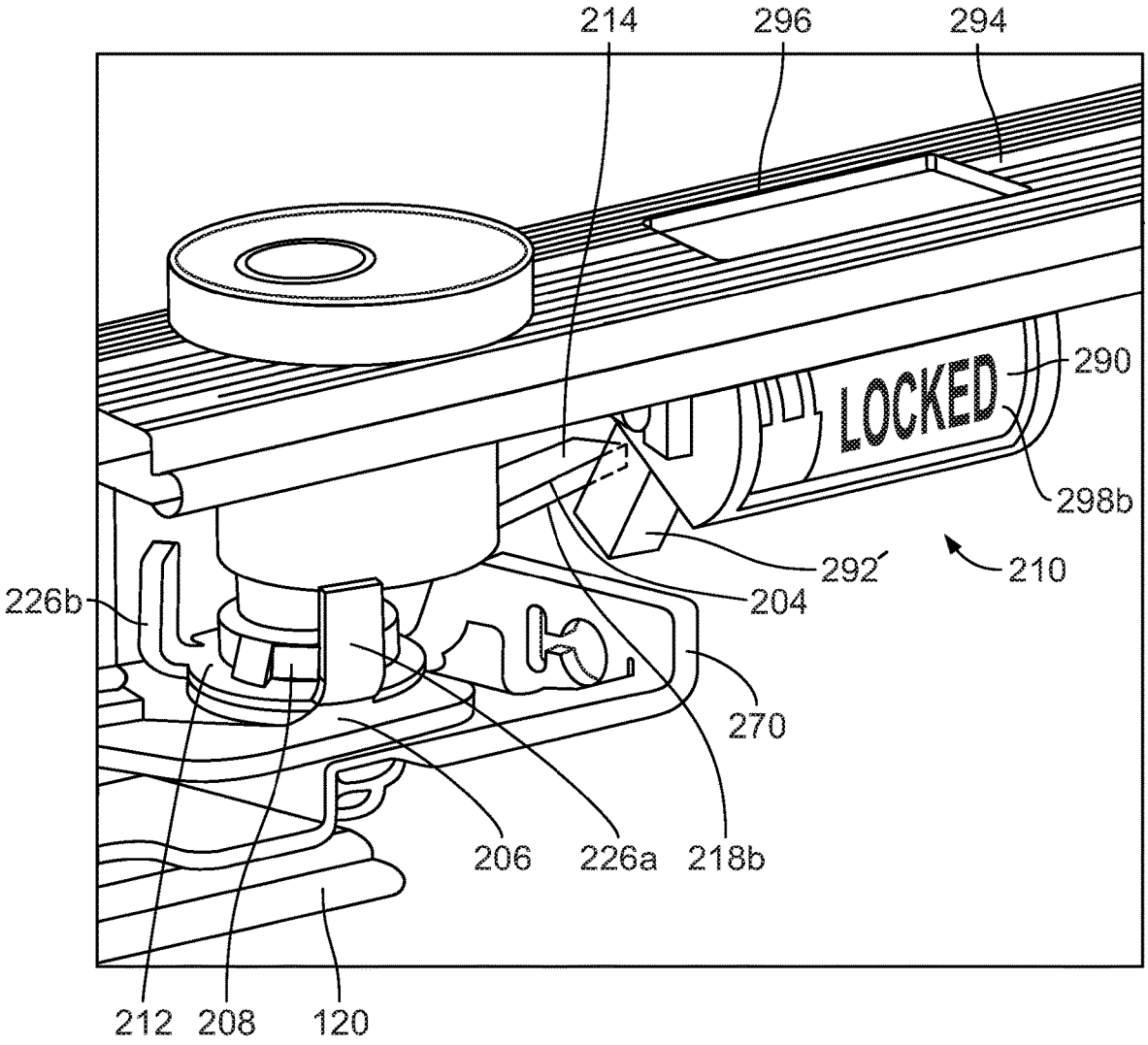
FIG. 9 illustrates a side perspective view of a dogging mechanism secured to a case cover of an exit device according to an illustrated embodiment of the present invention.
Figure 10:
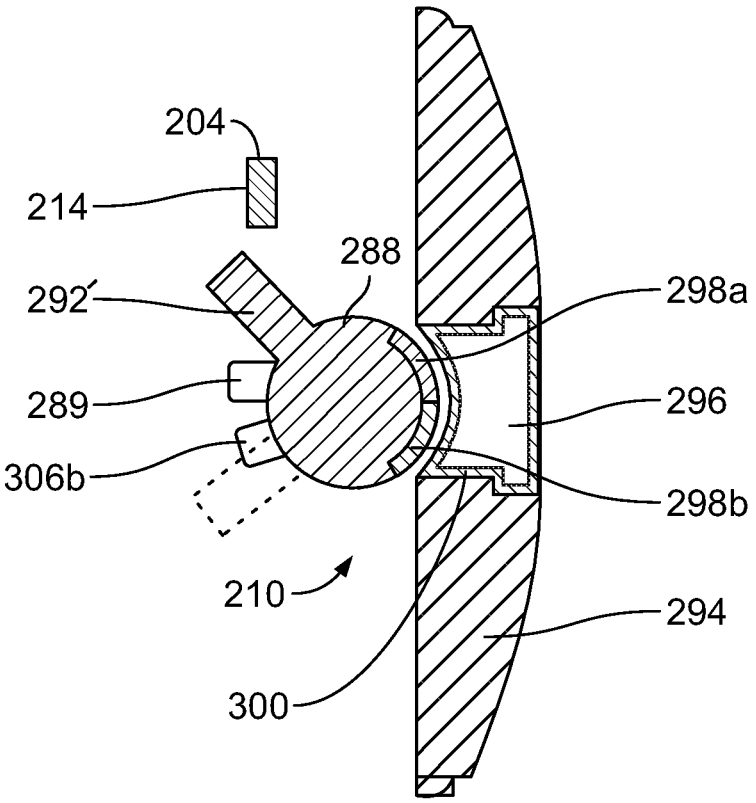
FIGS. 10 and 11 provide schematic representations of side and top cross sectional views, respectively, of portions of a dogging mechanism assembly according to an illustrated embodiment of the present invention.

FIGS. 9 and 10 illustrated an embodiment of the dogging mechanism assembly 200 in which the biasing element 316 is adapted to bias the indicator mechanism 288 to, or toward, the first indicator position. According to such embodiments, when the arm portion 214 of the actuator arm mechanism 204 is at the first position, the arm portion 214 may not be exerting a force, or a sufficient force, against engagement member 292' of the body section 290 to displace the indicator mechanism 288 away from the first indicator position. Instead, unlike the embodiment shown in FIGS. 12-15, when the arm portion 214 in the embodiment shown in FIGS. 9 and 10 is displaced toward the second position, the arm portion 214 exerts a force against the engagement member 292' of the indicator mechanism 288 that overcomes the biasing force of the biasing element 316 and displaces the indicator mechanism 288 from the first indicator position to the second indicator position. For example, in the illustrated embodiment, the displacement of the arm portion 214 toward the second position results in the arm portion 214 exerting a force against the engagement member 292' that facilitates the rotation of the indicator mechanism 288 about the indicator axis 312 from the first indicator position to the second indicator position. Conversely, according to such an embodiment, when the arm portion 214 is displaced from the second position to the first position, the biasing element 316 may provide a force that returns the indicator mechanism 288 from the second indicator position to the first indicator position. Additionally, according to such embodiments, when the arm portion 214 is in the first position, the arm portion 214 may or may not be in engagement with the engagement member 292' of the indicator mechanism 288.

Additionally, referencing FIG. 16, according to certain embodiments, the arm portion 214' may assert a force against a portion of the bottom or rear section 291 of the body section 290, which again may provide an engagement member 292, at a location that facilitates the rotational displacement of the indicator mechanism 288. Such force provided by the rotational displacement of the actuator arm mechanism 204 in a first direction against the indicator mechanism 288 may overcome the biasing force of the biasing element 316 and facilitate the rotational displacement of the indicator mechanism 288 about the indicator axis 312 from one of a first or second indicator positions to the other of the first and second indicator positions. As previously discussed, according to certain embodiments, the indicator mechanism 288 may continue to be displaced until rotational displacement of the arm portion 214' ceases and/or at least one of the posts 317*a*, 317*b* abuts against an adjacent leg portion 306*a*, 306*b* of the housing 289 in a manner that prevents continued rotational displacement of the indicator mechanism 288. Conversely, rotational displacement of the actuator arm mechanism 204 in a second, opposite direction, may displace the arm portion 214' to a location that does not impede or otherwise prevent the biasing element 316 from providing a force that returns the actuator mechanism 288 back to first or second indicator position. Further, according to the illustrated embodiment, the rotational displacement of the indicator mechanism 288 by the force of the biasing element 316 may also cease upon the engagement or abutment of the second post 317*b* against an adjacent leg portion 306*a*, 306*b* of the housing 289.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. An apparatus for selectively restraining displacement of a driver to retain a positon of a latch of an exit device, the apparatus comprising:

an arm assembly mounted for rotation between a first position and a second position, the arm assembly comprising:

a hook bracket engaging the driver when the arm assembly is in the first position and disengaging from the driver when the arm assembly is in the second position, the hook bracket preventing displacement of the driver when engaged with the driver;

an arm actuator mechanism including a body portion and an arm; and a coupler, wherein the hook bracket and the arm actuator mechanism are coupled for joint rotation between the first position and the second position by the coupler;

an actuator operably engaged with the arm assembly and operable to rotate the arm assembly between the first position and the second position; and an indicator mechanism structured for engagement with the arm of the arm actuator mechanism such that the indicator mechanism moves between a first indicator position and a second indicator position in response to rotation of the arm assembly between the first position and the second position, the indicator mechanism having one or more indicators that indicate a state of the driver when the indicator mechanism is in at least one of the first indicator position and the second indicator positions.

2. The apparatus of claim 1, wherein the arm assembly is structured to rotate between the first position and the second position about an axis of rotation, and wherein the indicator mechanism is structured to rotate between the first indicator position and the second indicator position about an indicator axis.

3. The apparatus of claim 2, further comprising a spring biasing the indicator mechanism toward one of the first indicator position and the second indicator position.

4. The apparatus of claim 1, wherein the hook bracket includes a first opening, wherein the body portion includes a second opening aligned with the first opening, and wherein the coupler is received in the first opening and the second opening such that the hook bracket and the arm actuator mechanism are coupled for joint rotation between the first position and the second position.

5. The apparatus of claim 4, wherein a first end of the actuator is adapted for engagement with a tool to facilitate rotation of the actuator to rotatably displace the arm assembly between the first position and the second position.

6. The apparatus of claim 5, wherein the coupler has an orifice, and wherein a second end of the actuator is received in the orifice such that the actuator is matingly engaged with the coupler.

7. The apparatus of claim 1, wherein the arm assembly further includes a pair of projections having a space defined therebetween, and wherein the actuator includes a cam projection extending into the space such that the cam projection is operable to engage the pair of projections to rotate the arm assembly between the first position and the second position.

8. An exit device including the apparatus of claim 1, wherein the driver is operably connected between the latch and a pushbar of the exit device, wherein the exit device has an actuated state in which the pushbar is in a depressed position, the driver is in an actuated position, and the latch is in a retracted position, and wherein with the arm assembly in the first position, the hook bracket retains the driver in the actuated position, thereby retaining the exit device in the actuated state.

9. The exit device of claim 8, further comprising a case cover including an opening through which at least a portion of the indicator mechanism is visible.

10. An apparatus for selectively dogging a driver of an exit device in an actuated position and for indicating a dogged/undogged state of the driver, the apparatus comprising:

a support bracket configured for mounting to a base plate of the exit device;

an arm assembly mounted to the support bracket for rotation between a first arm assembly position and a second arm assembly position, the arm assembly comprising:

an arm actuator mechanism rotatably mounted to the support bracket;

a hook bracket rotatably mounted to the support bracket; and a coupler rotatably mounted to the support bracket and rotationally coupling the arm actuator mechanism with the hook bracket for joint rotation; and an indicator assembly comprising a housing and an indicator mechanism movably mounted to the housing between a first indicator mechanism position in which the indicator mechanism indicates that the driver is dogged and a second indicator mechanism position in which the indicator mechanism indicates that the driver is undogged;

wherein, with the arm assembly in the first arm assembly position, the hook bracket is operable to dog the driver in the actuated position and the indicator mechanism occupies the first indicator mechanism position;

wherein, with the arm assembly in the second arm assembly position, the hook bracket is inoperable to dog the driver in the actuated position and the indicator mechanism occupies the second indicator mechanism position; and wherein the arm actuator mechanism is configured to move the indicator mechanism between the first indicator mechanism position and the second indicator mechanism position as the arm assembly rotates between the first arm assembly position and the second arm assembly position.

11. The apparatus of claim 10, wherein the indicator mechanism includes an engagement member that is engaged by the arm actuator mechanism to rotatably displace the indicator mechanism as the arm assembly is rotated between the first arm assembly position and the second arm assembly position.

12. The apparatus of claim 10, wherein the indicator mechanism comprises a first indicator indicating the dogged state; wherein the first indicator is aligned with a window in the housing when the indicator mechanism is in the first indicator mechanism position; wherein the indicator mechanism further comprises a second indicator indicating the undogged state; and wherein the second indicator is aligned with the window when the indicator mechanism is in the second indicator mechanism position.

13. The apparatus of claim 10, further comprising a spring biasing the indicator mechanism toward one of the first indicator mechanism position and the second indicator mechanism position.

14. The apparatus of claim 10, wherein the coupler extends through a first opening in the arm actuator mechanism and a second opening in the hook bracket and rotationally couples the arm actuator mechanism and the hook bracket.

15. An exit device including the apparatus of claim 10, wherein the driver is operably connected with a latch of the exit device, the latch having a retracted position in response to the actuated position of the driver, and wherein the exit device further comprises a case cover including an opening through which a portion of the indicator mechanism is visible.

16. An exit device, comprising:

a base plate configured for mounting to a door;

an indicator mechanism including an indicator relating to a dogged/undogged state of the exit device, the indicator mechanism having a first indicator position in which the indicator is visible, the indicator mechanism having a second indicator position in which the indicator is not visible;

a driver movably mounted to the base plate and having an actuated position and a deactuated position;

a pushbar operably coupled with the driver and operable to move the driver between the actuated position and the deactuated position;

a latch operably engaged with the driver such that actuation of the driver moves the latch from an extended position to a retracted position; and an arm assembly having a first arm assembly position and a second arm assembly position, the arm assembly comprising:

an arm actuator mechanism configured to drive the indicator mechanism between the first indicator position and the second indicator position as the arm assembly moves between the first arm assembly position and the second arm assembly position;

a hook bracket configured to retain the driver in the actuated position when the arm assembly is in the first arm assembly position, and to release the driver when the arm assembly is in the second arm assembly position; and a coupler engaged with the arm actuator mechanism and the hook bracket and coupling the arm actuator mechanism and the hook bracket for joint movement between the first arm assembly position and the second arm assembly position.

17. The exit device of claim 16, wherein the arm assembly is configured to rotate between the first arm assembly position and the second arm assembly position in a first direction and a second direction; and wherein the indicator mechanism includes an engagement member that is engaged by the arm actuator mechanism as the arm actuator mechanism rotates in at least one of the first direction and the second direction.

18. The exit device of claim 17, further comprising a housing that is coupled to a cover case of the exit device, and wherein the housing includes a window through which the indicator is visible when the indicator mechanism is in the first indicator position.

19. The exit device of claim 18, wherein the indicator mechanism further comprises a second indicator that is visible through the window when the indicator mechanism is in the second indicator position.

20. The exit device of claim 19, further comprising a spring urging the indicator mechanism to one of the first indicator position and the second indicator position.

* * * * *